US005458342A

United States Patent [19]

Hernandez

[11] Patent Number: 5,458,342

[45] Date of Patent: Oct. 17, 1995

[54] GAME FOR TEACHING MANUAL DEXTERITY

[76] Inventor: Leonel G. Hernandez, 2505 N. Main St., #26, Bastrop, Tex. 78602-4122

[21] Appl. No.: 354,720

[22] Filed: Dec. 6, 1994

[51] Int. Cl.[6] ..... A63F 9/00

[52] U.S. Cl. ..... 273/447

[58] Field of Search ..... 273/236, 266, 273/273, 276, 282.1, 440, 445, 447; 434/258, 259, 260; 368/45; D10/40, 6, 7, 8

[56] References Cited

U.S. PATENT DOCUMENTS

| | | | |
|---|---|---|---|
| D. 162,020 | 2/1951 | Fuchs . | |
| D. 286,381 | 10/1986 | Zeisel . | |
| 3,717,341 | 2/1973 | Blanton . | |
| 3,721,440 | 3/1973 | Burns . | |
| 3,954,262 | 5/1976 | Weber . | |
| 5,040,789 | 8/1991 | House . | |
| 5,193,808 | 3/1993 | Takeshi | 273/447 |
| 5,240,260 | 8/1993 | Strongin . | |
| 5,342,064 | 8/1994 | Williamson et al. | 273/447 |

FOREIGN PATENT DOCUMENTS 1517498 7/1978 United Kingdom .

1533473 11/1978 United Kingdom .

*Primary Examiner*—Vincent Millin
*Assistant Examiner*—William M. Pierce
*Attorney, Agent, or Firm*—Richard C. Litman

[57] ABSTRACT

A game for teaching manual dexterity provides a common tray or arena in which a plurality of individual playing pieces are placed face down. Separate sets of individual playing pieces (which may be differentiated by color), separate playing piece storage trays, and separate pairs of tongs for handling the individual playing pieces, are provided for each player. A timer is also provided to determine the duration of each player's turn. The common tray or arena, the individual playing pieces, the individual storage trays for each player, the tongs for each player, and the timer, are each formed with crenelated edges to resemble the configuration of a bottle cap with its crimped edges. The individual playing pieces are placed inverted, i. e., face down with the crenelated edges facing upward, in the common playing arena. Players all play simultaneously, with the object of the game being to turn each playing piece face up for that respective player, and then to remove each playing piece to the storage tray for that respective player. The player who removes the greatest number of his/her pieces from the arena before time expires, or who is first to do so before time expires, wins the round.

10 Claims, 5 Drawing Sheets

GAME FOR TEACHING MANUAL DEXTERITY

FIELD OF THE INVENTION

The present invention relates generally to games of physical skill, and more specifically to a game played on a specially formed surface involving the manipulation of playing pieces using a special tool. The playing surface or arena, the individual player retaining trays for the playing pieces, the playing pieces themselves, and the timer means for the game, are all configured to have the appearance of conventional bottle caps having crimped edges.

BACKGROUND OF THE INVENTION

In the past, a relatively simple children's game was developed in which bottle caps were placed within a circle or area on the ground, and the players would attempt to pick up the bottle caps within the circle by hand as rapidly as possible. The winner was the player who collected the most bottle caps from the circle. Informal rules were developed relating to the methods of picking up the caps, the positioning of the caps in the playing area, etc., which rules varied between players and games. In this respect, the game was somewhat like the well known game of marbles, in which an informal circle is drawn in the dirt for play; the only articles used in the play of the game are the marbles themselves. In the case of the bottle cap game, the bottle caps were the only articles used. The game served as an excellent means of developing hand eye coordination for small children in the days before video games and more complex and costly pastimes.

Many adults have fond memories of the above informal game, and lake pleasure in passing the game on to their children. While the game was extremely inexpensive to play, it was not without its hazards (e. g., the relatively sharp edges of the crimped metal bottle caps, etc.), and minor scrapes and cuts occurred from time to time. Such minor injuries could result in more serious consequences, given the bare earth playing area generally used and the resulting possibility of contamination of even a minor injury.

As the world has continued to develop, greater awareness of such potential hazards has evolved, and many parents have come to understand that there are better means of accomplishing various tasks than were used in their generation. It is also generally desired by parents that their children be protected from various risks to the greatest degree practicable. Accordingly, the need arises for a game apparatus for teaching manual dexterity, which avoids the various potential hazards discussed above, and allows children to play the game without undue hazard to themselves. Greater challenge may be provided by including relatively inexpensive timer means with the game apparatus, particularly a timer which provides an active indication of expired time or of a winning effort. Other means providing for the indirect handling of the game pieces may be provided to add further challenge to the game. The game playing pieces, as well as the playing area or arena, the individual player storage or retaining areas for the playing pieces, the playing piece handling tool, and the timer, may each be configured to have an appearance resembling a bottle cap having crimped edges, in order to relate to the origins of the game.

DESCRIPTION OF THE PRIOR ART

U.S. Pat. No. 3,717,341 issued to Colecta E. Blanton, Jr. on Feb. 20, 1973 discloses a Board Game Apparatus in which a pair of chopsticks is used to handle a plurality of rounded, smooth counters in moving the counters from one point to another on the game board. The present game board or arena includes an upturned periphery for containment of the playing pieces and is devoid of specific points within the arena. The game piece handling article the present game is a pair of tongs, rather than the chopsticks of the Blanton, Jr. game. Moreover, the present game is played using a timer, which is not disclosed by Blanton, Jr., and the object of the present game is to remove the pieces from the playing area, rather than transfer them from one point to another within the playing area or board.

U.S. Pat. No. 3,721,440 issued to Howard M. Burns on Mar. 20, 1973 discloses a Manual Dexterity Game in which a pickup device is slidingly secured on a string suspended between two remotely operated arms. Each of the arms is manipulated by one hand of the player. The object is to remotely move a game piece from one point to another on the playing surface. The timer means disclosed is a relatively simple sand glass and provides no active indication of expired time or of winning before time has expired. Moreover, the playing pieces are simple spheres, unlike the relatively complex configuration of the present game pieces and their resemblance to bottle caps. No all encompassing theme is disclosed by the configuration of the Burns Game, as with the bottle cap theme presented by the various components and articles used in the play of the present game.

U.S. Pat. No. 3,954,262 issued to Leonard J. Weber on May 4, 1976 discloses a Game Device wherein playing pieces are removed from a central area and placed in specific playing positions around the periphery of a circular board as rapidly as possible. The duration of time allowed is dependent upon the spinning of a top. When the top falls, the bottom of the central area is opened electronically to allow any remaining playing pieces to fall through, whereby access to them is precluded. Another conventional cluck is also used to time each turn. The relatively complex electrical apparatus of the game, the moving of playing pieces from a general central area to specific outlying points, and the use of another article (top) to determine the duration of each move, provide both a game apparatus and method of play unlike the present game.

U.S. Pat. No. 5,040,789 issued to Jimmy R. House on Aug. 20, 1991 discloses a Game Apparatus And Method For Playing A Game comprising a bladed game piece and a slotted receptacle therefor. The object of the game is to use a pair of sticks to pick up the playing piece and deposit it on the slotted receptacle, with the receptacle slots engaging the blades. A timer is used to time the duration of each move. No common playing surface or arena is provided, and only a single playing piece is disclosed. The timer provides no additional active features, as provided by the present timer.

U.S. Pat. No. 5,240,260 issued to Ned Strong in on Aug. 31, 1993 discloses a Toy Game Apparatus comprising a generally vertically disposed set of playing piece receptacles on a rotatable curved frame. The frame includes means to cause the rotation thereof when triggered by a sound, thus causing the receptacles to move and making it more difficult for a player to place any playing pieces in the receptacles. No timer means is disclosed. The object is to place playing pieces on specific points of the intermittently moving apparatus by using a pair of tongs, rather than to remove playing pieces from a playing surface or arena. The relatively complex electronic apparatus providing for movement of the vertical array of playing piece receptacles, is unlike the relatively simple configuration of the present game apparatus with its relatively flat, tray like playing area and individual areas for each player's game pieces.

U.S. Pat. No. D-162,020 issued to Stanley F. Fuchs on Feb. 20, 1951 discloses a design for a Game Counter Or Similar Article, having the general configuration of a coin with milled edges. The design is unlike the bottle cap like configuration of the various articles of the present game apparatus, with their crenelated edges resembling the crimped edges of bottle caps.

U.S. Pat. No. D-286,381 issued to Hans K. Zeisel on Oct. 28, 1986 discloses a design for an Alarm Clock including a facial caricature thereon and simulated arms and legs. No means is disclosed for movement of the arms or to deliver a recorded message, as provided by the present timer means.

British Patent No. 1,517,498 to Agatsuma Ltd. and published on Jul. 12, 1978 discloses an Apparatus For Playing A Game comprising a game board having a plurality of remotely actuated grasping slides thereon. The slides are manipulated in an attempt to grasp balls in the center of the board and move them to individual player storage areas. No timer means is disclosed, nor are the storage areas or playing piece handling apparatus separate from the board, as provided by the present game.

Finally, British Patent No. 1,533,473 to Marvin Glass And Associates and published on Nov. 22, 1978 discloses a Playing Object Retrieval Game in which a plurality of playing pieces resembling pickles are placed in a jar. The object is to remove the playing pieces using a tool resembling a fork with bent tines. No timer means, central playing arena or board, or individual receptacles for each player's playing pieces is disclosed, as provided by the present game apparatus.

None of the above noted patents, taken either singly or in combination, are seen to disclose the specific arrangement of concepts disclosed by the present invention.

SUMMARY OF THE INVENTION

By the present invention, an improved game for teaching manual dexterity is disclosed.

Accordingly, one of the objects of the present invention is to provide an improved game for teaching manual dexterity which includes game apparatus comprising a common board or arena for the individual playing pieces, a separate playing piece retaining tray for each player, and a plurality of individual playing pieces, with the above articles each being formed to resemble a bottle cap with crimped edges.

Another of the objects of the present invention is to provide an improved game for teaching manual dexterity which includes means for the indirect handling of playing pieces, comprising tongs for each player which grasping ends each resemble a bottle cap.

Yet another of the objects of the present invention is to provide an improved game for teaching manual dexterity which includes timer means for determining each player's turn duration.

Still another of the objects of the present invention is to provide an improved game for teaching manual dexterity which timer means is adjustable for a predetermined time duration, and which activates a physical and/or aural indication of expired time or of completion of a turn before the time is expired.

A further object of the present invention is to provide an improved game for teaching manual dexterity which timer means also includes resemblance to a bottle cap, thus providing a common theme for all of the articles used in the play of the game.

An additional object of the present invention is to provide an improved game for teaching manual dexterity which various components may further include facial caricatures thereon, which caricatures may be molded or otherwise formed to be integral with the articles of the game apparatus to preclude the removal thereof.

Another object of the present invention is to provide an improved game for teaching manual dexterity which individual player piece retaining trays for each player are of different colors in order to distinguish therebetween, and which associated individual playing pieces for each player and the tongs used for the grasping thereof are each of like color to their associated tray.

Yet another object of the present invention is to provide an improved game for teaching manual dexterity which game is particularly suited to play by small children, and which game components are devoid of sharp edges and other hazards to small children.

A final object of the present invention is to provide an improved game for teaching manual dexterity for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
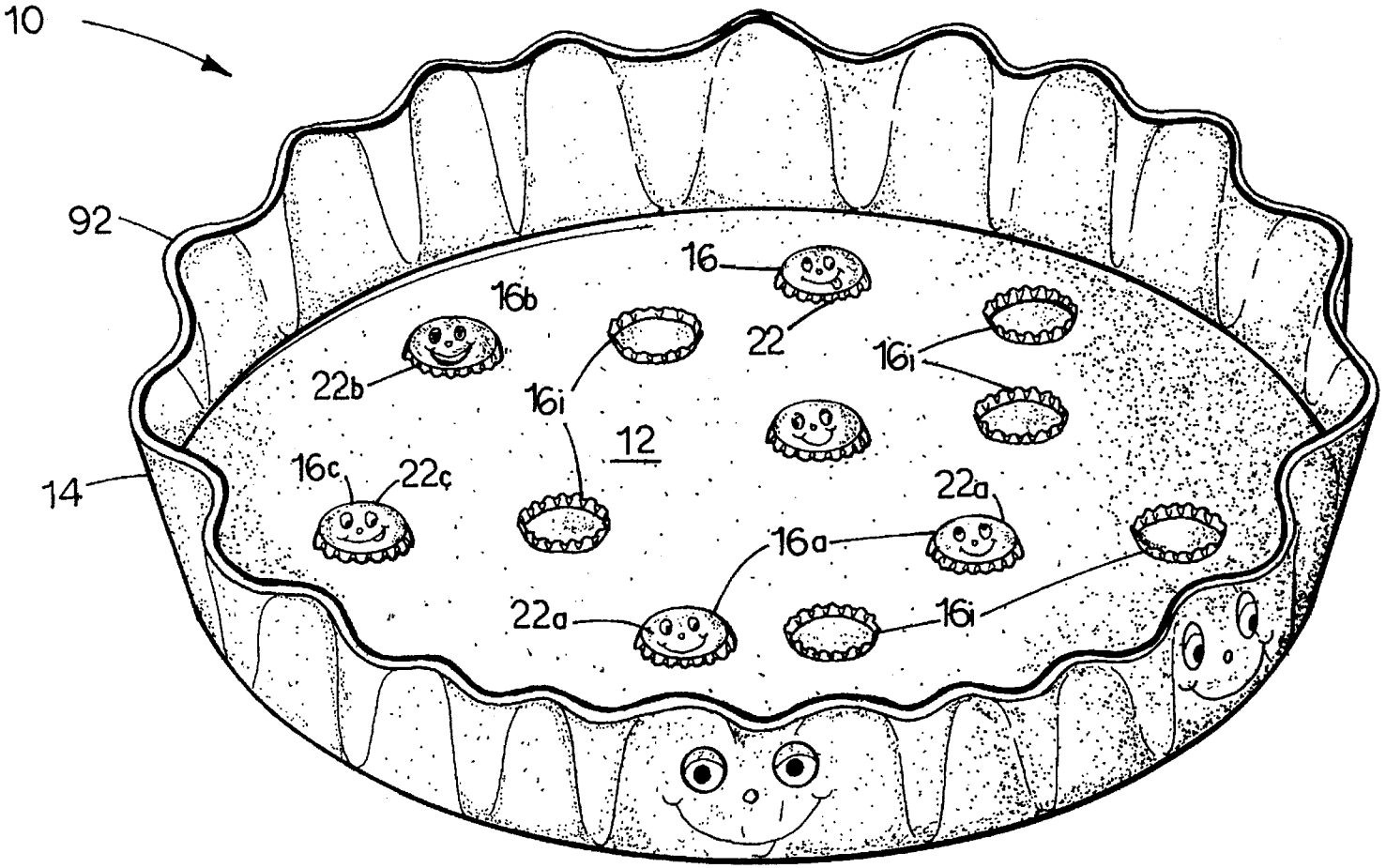
FIG. 1 is a perspective view of the common Game tray or arena of the present Game, showing a plurality of upright and inverted individual Game playing pieces placed therein.

Referring now to the drawings, the present invention will be seen to relate to a game for teaching manual dexterity, and game apparatus therefor. FIG. 1 of the drawings discloses a tray or arena 10 which is used in the play of the game. A single arena 10 is provided, with its use common to all players of the game. The arena 10 generally comprises a round and flat sheet of material 12 forming a playing surface, with a crenelated peripheral wall 14 therearound to form a generally circular periphery. The resulting configuration will be seen to resemble an inverted bottle cap with its crimped edge extending upwardly therearound.

Figure 2:
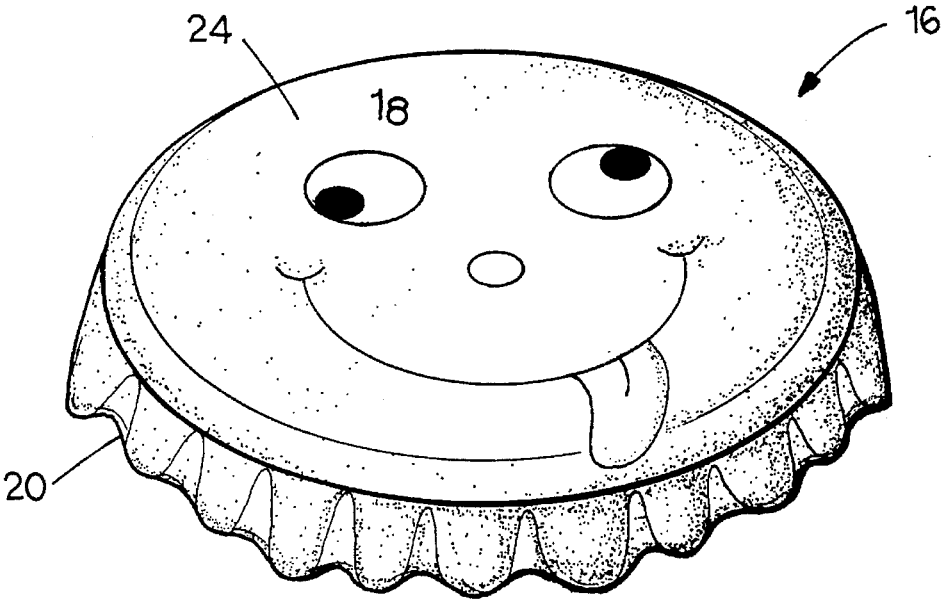
FIG. 2 is an enlarged perspective view of an inverted individual playing piece of the present Game, showing its bottom surface.

The arena or tray 10 is of sufficient size to provide for the initial placement and containment of a plurality of individual game playing pieces 16 therein; a perspective view of a typical upwardly facing playing piece 16 is shown in FIG. 2 of the drawings. Each individual playing piece 16 is similarly configured to the arena area 10 discussed above, and includes a generally round central area 18 having a crenelated peripheral wall 20 extending therefrom to resemble a crimped bottle cap.

The individual playing pieces 16 may be divided into a plurality of groups of like pieces 16, with the pieces 16 of the different groups being differently configured in some way in order to distinguish between pieces 16 of each group. Preferably, each group is of a different color (e. g., green, yellow, orange, purple, etc.; other colors may be used as desired) to enable small children to recognize playing pieces 16 belonging to a given group. The use of different colors for each group is particularly advantageous for smaller children who have not yet developed fine perception skills to distinguish more subtle differences.

Alternatively, different facial caricatures (e.g., caricature 22 of FIG. 2) may be provided on the top or upper sides 24 of the playing pieces 16 of the different groups, in order to differentiate between the different groups. Each playing piece 16 of a given group includes like caricatures or expressions on the caricatures; this is indicated in FIG. 1, with each of the playing pieces **16*a* having like facial caricatures 22*a* thereon, pieces 16*b* having like caricatures 22*b* thereon, 16*c* having like caricatures 22*c*** thereon, etc.

Preferably, the caricatures 22 are integrally formed on each of the playing pieces 16 (and other areas discussed further below), rather than by means of decals or the like which may be peeled off and possibly ingested by small children. The caricatures 22 may be embossed in the top or upper surface 24 of each of the playing pieces 16, molded or cast in at the time of manufacture, etc. The same techniques may be used for other caricatures used on other game components. If the different groups of playing pieces 16 are formed using different colors to distinguish between each group, then each of the game components may be formed having randomly configured caricatures, or identical caricatures as desired.

Figure 3:
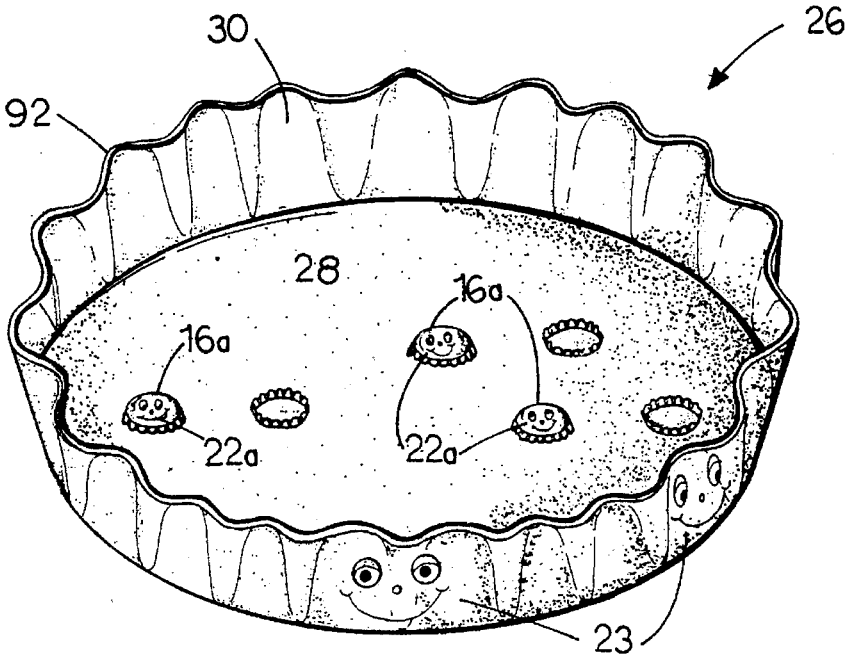
FIG. 3 is a perspective view of an individual player's container or receptacle for the storage of playing pieces therein, after they have been removed from the common arena.

The object of the game is for each player to remove the playing pieces of his/her group from the common arena 10 as rapidly as possible, and place them in a receptacle 26 dedicated to the playing pieces 16 of that player. FIG. 3 discloses a perspective view of such a receptacle 26, including a plurality of playing pieces **16*a* therein. The receptacle 26 is configured similarly to the playing pieces 16 and arena 10 discussed above, having a round, flat central sheet 28 surrounded by a generally circular crenelated peripheral wall 30** generally resembling a bottle cap.

The receptacles 26 for each player's group of playing pieces 16 are also preferably formed in the same color as that used for the corresponding group of playing pieces 16. In the example of FIG. 3, like playing pieces **16*a* are shown within the receptacle 26, and each of the pieces 16*a* includes a like caricature 22*a* thereon. If like caricatures are to be used to differentiate between the different groups, then a larger caricature 23 of like configuration to that of the caricatures 22 of the game pieces of that group may be provided on the exterior of the peripheral wall 30 of the receptacle 26. Thus, each player may quickly and easily recognize the specific receptacle 26 corresponding to his/her group of playing pieces 16**, either by color, caricature expression, or other means as desired.

Figure 4:
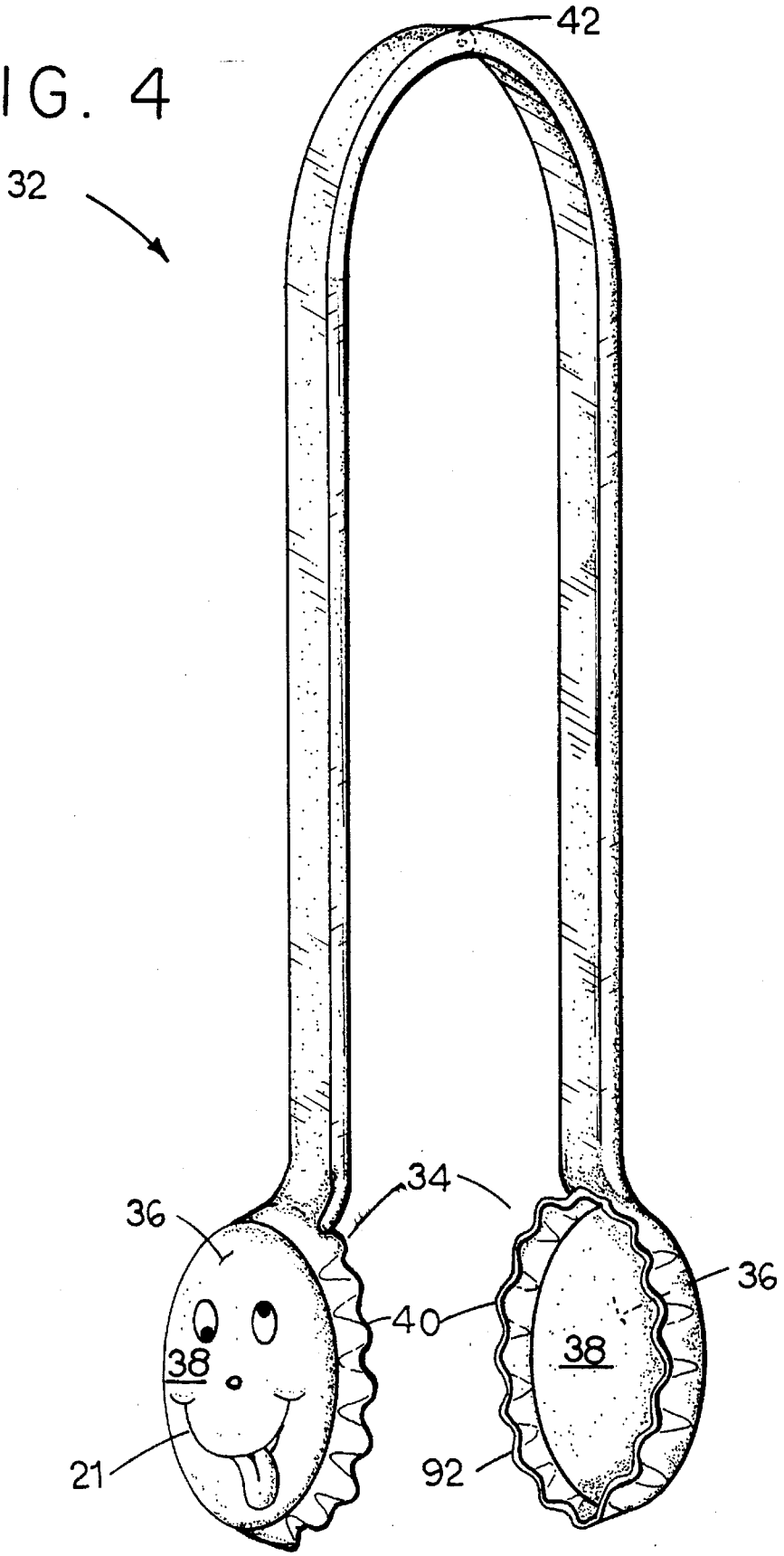
FIG. 4 is a perspective view of one set of tongs used for the manipulation of the individual playing pieces of the game.

FIG. 4 discloses a pair of tongs 32 used in the play of the present game. The tongs 32 include two normally spaced apart grasping ends 34 opposite one another, with their outer surfaces 36 (equivalent to the top surfaces 24 of the playing pieces 16; one outer surface 36 is shown in FIG. 3) facing away from one another. The grasping ends 34 each further include a generally round central area 38, surrounded by a crenelated wall 40, as in the other components discussed above, and serving to resemble a bottle cap and thus providing a common theme for the game components. The grasping ends 34 of the tongs 32 are preferably biased apart to remain normally open, with closure power provided by the player using the tongs 32. A spring biased hinge 42 may be used to secure the tong components together and bias the grasping ends 34 apart, or alternatively the tongs 32 may be formed of a flexible resilient material which spaces the grasping ends 34 apart until squeezed together to grasp an article.

A facial caricature 21 may be provided on each outer surface 36 of the grasping ends 34 as desired. A pair of tongs 32 is provided to each player, with each pair of tongs 32 having a configuration (color, etc.) common to the playing pieces 16 and receptacle 26 of a given group. In the case of the tongs 32 of FIG. 4, it will be seen that the caricature 21 is of the same likeness as that of the playing pieces 16 of FIGS. 1 and 2, thus identifying that pair of tongs 32 with the group of playing pieces 16.

Figure 5:
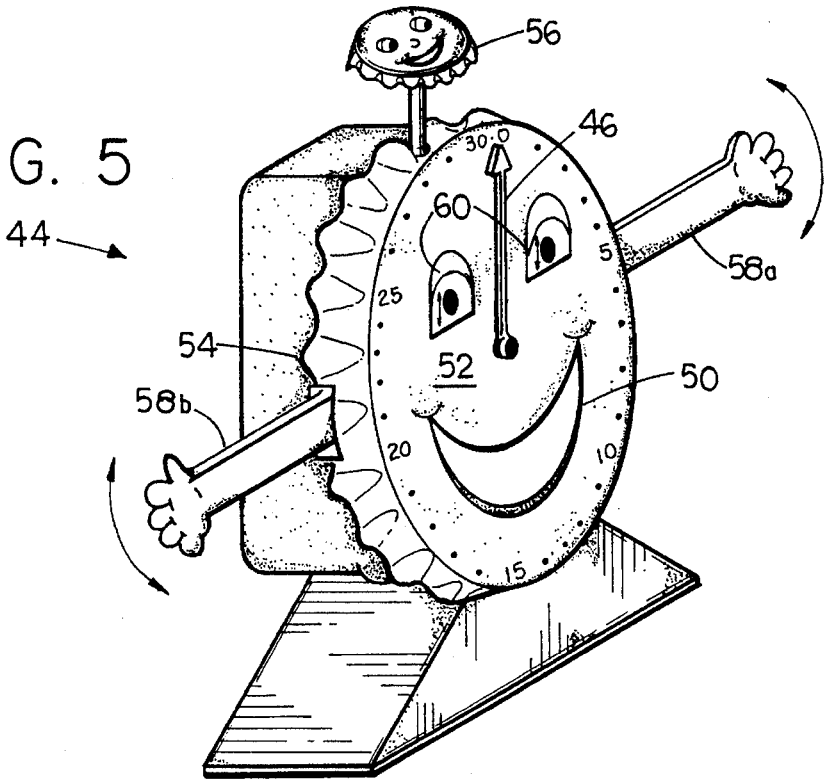
FIG. 5 is a perspective view of the timer means or clock used in timing the duration of each player's turn during the course of play, and showing its features.

The game is played against a predetermined time interval, and accordingly a timer 44 is provided, as shown in FIG. 5. The timer 44 provides for the setting and timing of predetermined amounts of elapsed times from zero to thirty seconds; other intervals may be used as desired. A hand 46 may be set to the desired time interval, with the timer 44 providing an indication by means of an audible alarm 48 (e. g., ringing bell, as in the schematic of FIG. 7, or other means) when the time interval has elapsed. The timer may also include a facial caricature 50 similar to those discussed above, but of a generic nature so as not to be exactly like any of the caricatures of any of the groups of components discussed above, as only a single timer 44 is provided for all of the players of the game. It will further be noted that the timer includes a generally round front surface 52, with a crenelated border 54 extending rearwardly therefrom, to provide a bottle cap appearance in keeping with the common theme developed by each of the components of the game. In addition to the bottle caplike appearance of the face 52 of the timer 44, a stop button 56 having a configuration resembling a bottle cap is also provided atop the timer 44, which function is explained further below.

Figure 6:
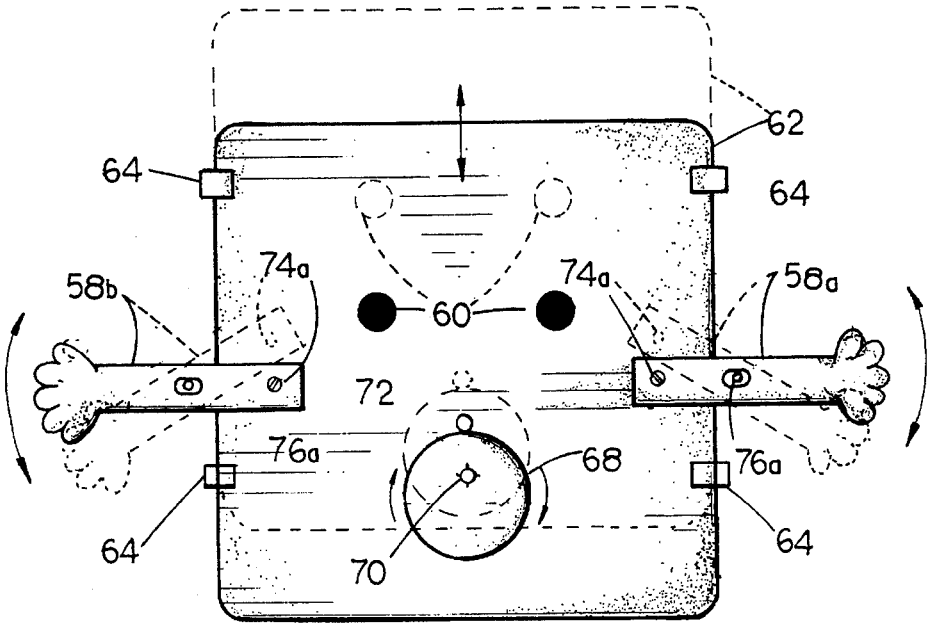
FIG. 6 is an elevation view of the mechanism of the timer, showing the operation of the arms and facial features of the timer.

In addition to the alarm means 48, the timer 44 also includes other mechanical means for alerting players of the expiration of time, in the form of left and right arms **58*a* and 58*b* and "pupils" 60, which move when time has expired. The mechanical means providing for the operation of these components 58*a*, 58*b*, and 60 is shown in FIG. 6. A central plate 62 is provided within the clock or timer 44, which plate 62 is free to move vertically through a predetermined range but is retained laterally by upper and lower, left and right retainers 64. A motor 66 (shown schematically in FIG. 7) which may be electric, mechanical spring powered, etc., drives an eccentric wheel 68, which is pivoted on a shaft 70. A pin 72 extends outwardly from the plate 62. When the eccentric wheel 68 is rotated by the motor 66, the pin 72 is oscillated upwardly and downwardly, thereby causing the plate 62 to from which it extends to oscillate upwardly and downwardly. The "pupils" 60, stamped, painted or otherwise formed on the plate 62, will thus appear to move upwardly and downwardly within the open eyes of the timer face 52, to add animation to the timer means 44**.

The arms 58*a* and 58*b* are pivotally secured to the plate 62 respectively at pivots 74a and 74b, and are pivotally secured to the case or other fixed structure of the timer 44 by pins 76*a* and 76*b*. (The arms 58*a* and 58*b* may be slotted, as shown, to allow for longitudinal movement during their actuation.) Thus, when the motor 66 is actuated, the eccentric wheel 68 causes the pin 72 and plate 62 to which it is attached to move upwardly and downwardly, thus causing the "pupils" 60 to move upwardly and downwardly within the open eyes of the timer face 52, and further causing the arms 58*a* and 58*b* to wave, by pivoting about the arm/timer pivots 76*a* and 76*b*. The result adds to the excitement of the game.

Figure 7:
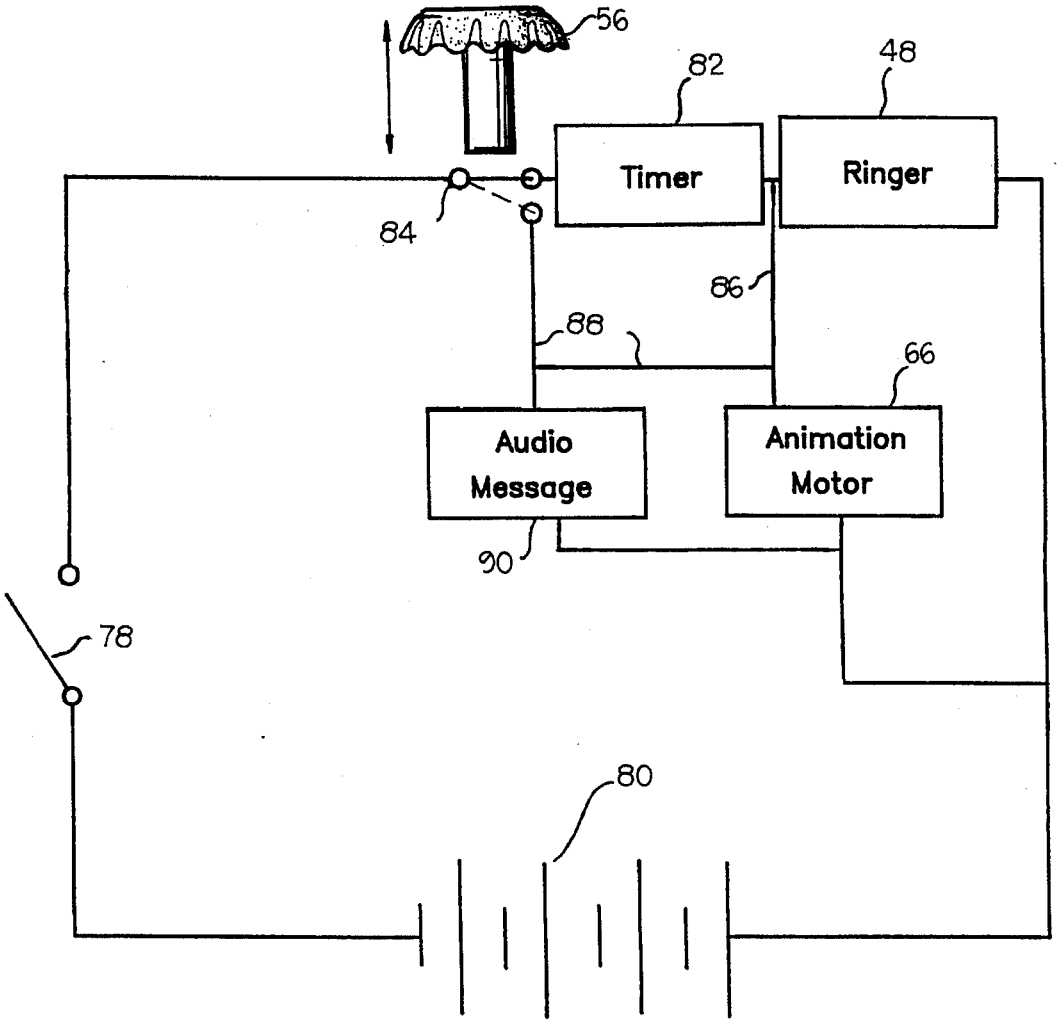
FIG. 7 is a block diagram and electrical schematic showing the operation of the timer.

FIG. 7 provides a combination electrical schematic and block diagram of the operation of the timer 44. An on/off switch 78 is provided to close the general circuit for the timer 44, enabling the timer 44 to operate. An electrical battery or batteries 80 may be provided for power. A timing device 82 (as in kitchen timers and the like) provides for the timing of intervals preferably from zero to thirty seconds; other intervals of longer duration may be used. The timing device 82 may be set by turning the timer hand 46 to the desired setting, and allowing the timer device 82 to count down until time is expired, or otherwise set. (Digital timing may also be used, but such means would not provide the caricature of the present timer means 44.) A manually activated alarm stop switch 84 has a normally closed first position, but may be opened by means of the timer stop button 56 to deactivate the timing device 82, and the audible alarm or ringer 48 and animation motor 66, each of which are normally activated by the timing device 82 when the preselected time expires to close the conventional internal switch (not shown).

In normal operation, the on/off switch 78 first position is closed and the timing device 82 is set as desired and allowed to run to the end of the preselected time duration, whereupon the timing device 82 conventional internal switch closes to provide power to the audible alarm means or ringer 48, and also to the animation motor 66 by means of animation motor first circuit 86 which obtains its source of power from the audible alarm circuit. The alarm or ringer 48 will then sound, along with simultaneous actuation of the timer arms 58*a* and 58*b* and the "pupils" 60, by means of the animation motor 66 causing the plate 62 to oscillate upwardly and downwardly as described further above.

In the event that a player completes a turn or round before time expires, that player may open the normally closed alarm stop switch by hitting or pushing the timer stop button 56, thus preventing power from reaching the alarm or ringer means 48 and the animation motor 66 by means of the motor first circuit 86. However, it will be seen that this will close an alternate second circuit 88, allowing power to flow to an audible message 90, stating "you win, you win" or other suitable message as desired, and further activating the animation motor 66 by means of the second circuit 88. (A diode, not shown, may be installed in the first animation motor circuit 86 to prevent current flow through the second circuit 88 and thence back through the first circuit 86 to activate the audible alarm or ringer 48.)

The game is played is by placing an equal number of the individual playing pieces 16, 16*a*, 16*b*, etc. for each player within the arena 10, with all of the playing pieces 16 being inverted (top surface facing downward, as shown by the playing pieces 16*i* in FIG. 1). The timer means 44 is then activated, and all of the players simultaneously attempt first to flip over or turn upright each of their individual playing pieces 16, 16*a*, etc., and then to remove those playing pieces to their respective receptacle 26, by using his/her tongs 32. (It will be noted that some of the playing pieces 16*a* shown in FIG. 3 have been tossed into the receptacle 26 to rest in an inverted position. Game rules may require specifically that each of the playing pieces 16 be placed upright in their respective receptacles 26, if desired.) The object is to be the first player to complete the two above steps of turning his/her playing pieces 16 upright, and then removing them from the arena 10 and placing theme in his/her receptacle 26.

If time expires before any of the players have accomplished the above steps, the timer means 44 will cause the audible alarm or ringer 48 and the animation motor 66 to be activated, signaling the players that they did not accomplish the removal of their respective playing pieces 16 within the allotted time. However, if one of the players is able to remove his/her playing pieces 16 from the arena 10 and place them within his/her respective receptacle 26 before time expires, then that player may hit the timer stop button 56 on the timer 44, thus opening the timer 82 circuit and closing the second circuit 88 to activate both the "you win, you win" audible message 90 and the animation motor 66 to cause the arms 58*a* and 58*b* and the pupils 60 of the timer 44 to be activated, signaling a winning player.

The above described game and apparatus providing for the play thereof, is particularly valuable in teaching hand - eye coordination for smaller children and others needing such development. The different colors provided for the different groups of playing pieces and their associated receptacles and tongs, are easily recognized by smaller children. Alternatively, other differentiation means (different caricatures, etc.) may be used. No specific number of playing pieces 16 is required, as the game may be played with a relatively few for smaller children, and more added for more advanced play. The use of safe plastic materials with smoothly rounded borders 92 devoid of sharp edges, provides a safe game apparatus which recreates the bottle cap origins of the original game, without its potential hazards.

It is to be understood that the present invention is not limited to the sole embodiment described above, but encompasses any and all embodiments within the scope of the following claims.

I claim:

1. A game for teaching manual dexterity for a plurality of players, comprising:

a plurality of groups of individual playing pieces, with each of said playing pieces having a top surface and an opposite bottom surface of different configuration and with each of said groups having means providing for differentiation from other said groups;

a common playing arena, providing for placement of said groups of individual playing pieces therein;

a plurality of receptacles providing for the containment of said individual playing pieces when said individual playing pieces are removed from said common playing area, with each of said receptacles corresponding to one of said groups of individual playing pieces and including means providing for identification with said corresponding one of said groups and for differentiation.

from other said receptacles;

a plurality of tongs providing for the grasping of said individual playing pieces, with each of said tongs corresponding to one of said groups of individual playing pieces and including means providing for identification with said corresponding one of said groups and for differentiation from other said tongs, and;

timer means providing for the determination of an interval of time for a turn of play, whereby;

each of said groups of playing pieces, said receptacles, and said tongs are assigned to different players, said playing pieces are randomly placed inverted within said common playing arena with said bottom surface of each of said playing pieces facing upward, and each of the players simultaneously first attempts to turn upright said playing pieces assigned to that player by means of said tongs assigned to that player and then attempts to remove said playing pieces assigned to that player to said receptacle assigned to that player by means of said tongs assigned to that player, with play being limited by said timer means.

2. The game for teaching manual dexterity of claim 1 wherein:

at least said playing pieces, said arena, said receptacles, and said tongs are each formed of plastic material.

3. The game for teaching manual dexterity of claim 1 wherein:

said playing pieces, said arena, and said receptacles are each formed of a round sheet of material having a crenelated border portion forming a generally circular peripheral wall therearound, said tongs each have two round grasping ends each having a crenelated border portion forming a generally circular peripheral wall therearound, and said timer means includes around face having a generally circular crenelated border therearound, to provide a common configuration resembling a crimped bottle cap for said playing pieces, said arena, said receptacles, said tongs, and said timer means.

4. The game for teaching manual dexterity of claim 3 wherein:

each said crenelated border of said playing pieces, said arena, said receptacles, said grasping ends of said tongs, and timer means comprises a smoothly rounded form devoid of sharp edges.

5. The game for teaching manual dexterity of claim 3 wherein:

said top surface of each of said playing pieces, each said peripheral wall of said arena and said receptacles, said grasping ends of said tongs, and said timer means each include at least one facial caricature embossed thereon.

6. The game for teaching manual dexterity of claim 5 wherein:

said means providing for differentiation between said groups of playing pieces, said corresponding receptacles, and said corresponding tongs comprises providing each of said groups of playing pieces, each of said corresponding receptacles, and each of said corresponding tongs with a different said facial caricature, and said means providing for identification of each of said corresponding receptacles and each of said corresponding tong switch each of said corresponding one of said groups of playing pieces comprises providing said each of said corresponding receptacles, said each of said corresponding tongs, and each of said corresponding one of said groups with a like said facial caricature.

7. The game for teaching manual dexterity of claim 1 wherein:

said means providing for differentiation between said groups of playing pieces, said corresponding receptacles, and said corresponding tongs comprises forming each of said groups of playing pieces, each of said corresponding receptacles, and each of said corresponding tongs of a different color, and said means providing for identification of each of said corresponding receptacles and each of said corresponding tongs with each of said corresponding one of said groups of playing pieces comprises forming said each of said corresponding receptacles, said each of said corresponding tongs, and each of said corresponding one of said groups to be of like color.

8. The game for teaching manual dexterity of claim 1 wherein:

said timer means includes a facial caricature thereon including movable eyes therein, left and right laterally disposed movable arms extending therefrom, and an animation motor, with said movable eyes and movable arms adapted to move when said animation motor is activated.

9. The game for teaching manual dexterity of claim 8 wherein:

said timer means includes an audible alarm therein, adapted to activate after a predetermined time has expired and further adapted to activate said animation motor after a predetermined time has expired.

10. The game for teaching manual dexterity of claim 8 wherein:

said timer means includes an audible message therein serving to notify a player of a winning turn, adapted to activate when said timer means is deactivated before the expiration of a predetermined time.

* * * * *